United States Patent [19]

Tradigo et al.

[11] Patent Number: 4,554,694

[45] Date of Patent: Nov. 26, 1985

[54] EXTENSIBLE SHOE SHAPER

[75] Inventors: Angelo Tradigo; Francesco Tradigo, both of Milan, Italy

[73] Assignee: Giovanni Tradigo S.n.c., Italy

[21] Appl. No.: 586,984

[22] Filed: Mar. 7, 1984

[30] Foreign Application Priority Data

Mar. 9, 1984 [IT] Italy ..... 19982 A/83

[51] Int. Cl.[4] ..... A43D 3/14; A43D 3/00

[52] U.S. Cl. ..... 12/136 B; 12/136 R; 12/128 R

[58] Field of Search ..... 12/128 R, 128 V, 133 R, 12/136 R, 136 B, 136 C, 135 A

[56] References Cited

U.S. PATENT DOCUMENTS

| | | | |
|---|---|---|---|
| 149,446 | 4/1874 | Compton et al. | 12/128 V |
| 166,499 | 8/1875 | Cass et al. | 12/128 R |
| 848,038 | 3/1907 | Mackenzie | 12/136 R |
| 870,064 | 11/1907 | Weeks | 12/136 R |
| 934,556 | 9/1909 | Malmberg | 12/128 V |
| 1,232,529 | 7/1917 | Gilbertson | 12/128 R |
| 1,686,133 | 10/1928 | Hill | 12/128 V |
| 1,921,093 | 8/1933 | Olson | 12/128 V |
| 2,000,340 | 5/1935 | Marca et al. | 12/128 V |

*Primary Examiner*—Henry S. Jaudon
*Assistant Examiner*—Steven N. Meyers
*Attorney, Agent, or Firm*—Robbins & Laramie

[57] ABSTRACT

In an extensible shoe shaper, the toe and heel are connected by means of a kinematic hinge element, formed of a plastic material strip of varying thickness applied by pressure, the configuration of which can be varied—in order to vary the extension of the shaper—by means of a screw handwheel, slidably fixed to the toe and acting on said kinematic element.

4 Claims, 3 Drawing Figures

EXTENSIBLE SHOE SHAPER

BACKGROUND OF THE INVENTION

The present invention relates to an extensible shaper for footwear, or shoe stretcher, having modern and rational constructive and functional characteristics and being designed to advantageously replace the devices of this type now in use.

In actual fact, a large variety of types of shoe stretchers or extensible shapers, meant for use with a limited range of footwear of different sizes, is already known on the market, most of these types still suffering from their origins and development which are typical of handicraft, while the attempts made on an industrial scale have led to complicated and costly structures. All these types are of scarcely practical use and they look quite unattractive as they tend to prevail over the shoe into which they should fit; many of them require the use of costly, or heavy, or scarcely suited materials. All this has determined the need to throw on the market a modern shoe shaper, easy to manufacture with a few mass-produced pieces made of inexpensive and suitable materials, easily and rapidly assembled, which is furthermore of convenient, easy and quick use and which, once it has been fit into a shoe, will not catch the eye of the observer and will focus all the attention on said shoe.

SUMMARY OF THE INVENTION

The present invention satisfies these requirements, supplying an extensible shaper or shoe stretcher, characterized in that, the connection between the front part or toe and the rear part or heel of said shaper is obtained by means of a kinematic hinge element, the configuration of which can be varied by means of a screw handwheel, slidably fixed along one of said parts and acting on said element.

Preferably, the kinematic hinge element is formed of a single strip of synthetic plastic material of varying thickness, fixed to the toe by pressure joints and connected to the heel by means of pressure hinges, the function of the hinges in said strip being performed by strip portions of reduced thickness.

Also preferably, the toe comprises a pair of guides, into which are slidably housed a flange for connection of the screw handwheel and the portion of the plastic material strip, forming said kinematic element, hinged to the heel.

BRIEF DESCRIPTION OF THE DRAWINGS

The invention will now be described in further detail hereinafter, with reference to a preferred embodiment thereof, illustrated in the accompanying drawing, in which.

DESCRIPTION OF THE PREFERRED EMBODIMENTS

Figures 1, 2, 3:
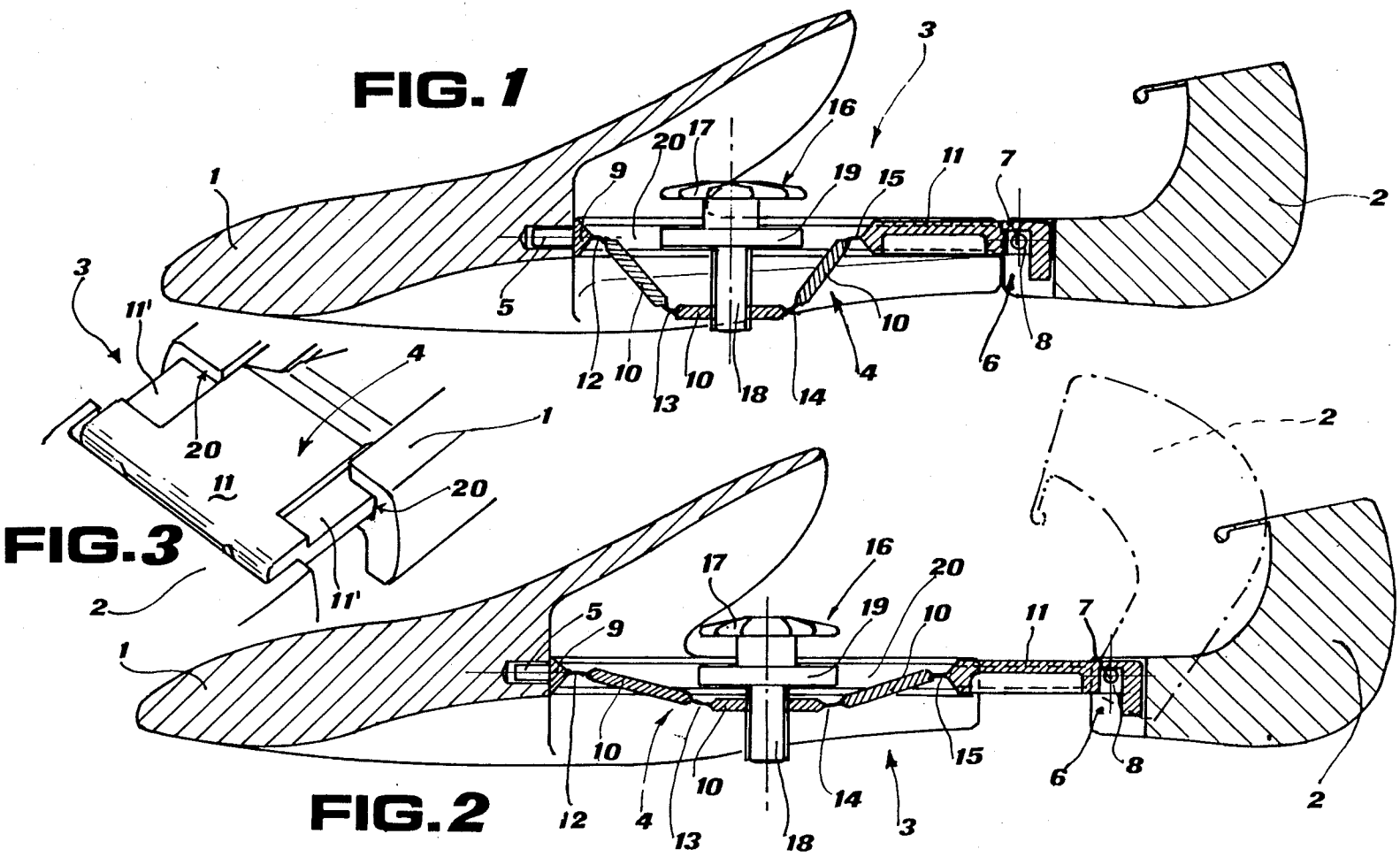
FIG. 1 is a longitudinal section view of a first configuration of the shaper according to the invention.
FIG. 2 is a view similar to that of FIG. 1, but of a different, more elongated configuration of said shaper.
FIG. 3 is a perspective detail of the connection between the components of the shaper of FIGS. 1 and 2.

With reference to the drawing, the shaper or shoe stretcher according to the invention comprises a front part or toe 1 and a rear part or heel 2, reciprocally connected by means of a kinematic element 3. This element 3 consists of a strip 4 of synthetic plastic material of variable thickness, being fixed by means of pressure joints 5 into the toe 1 and being connected by means of hinges 6 to the heel 2, through pressure insertion of pintles 7 of said heel 2 into seats 8 of the strip end. The strip 4 comprises a first thick section 9 carrying the joints 5, a group of three thick sections 10, forming a portion with variable configuration of the kinematic element 3, and a thick end section 11 carrying the seats 8 for the hinged connection with the heel 2. Between the thick sections 9, 10 and 11, the strip 4 has short narrow sections 12, 13, 14 and 15, apt to perform the function of hinges in order to give to the element 3 widely variable configurations.

The shaper is completed by a screw handwheel 16, formed of an operating member 17, of a screw shank 18 which engages into a nut screw obtained at the center of the thick middle section 10 of the strip 4, and of an intermediate flange 19, slidably arranged in two opposite guides 20 of the toe 1 in order to connect the handwheel to said toe so that it may slide along the same. In the same guides 20 is partially housed the thick end section 11 of the element 3, with its slightly depressed edges 11'. The pitch of the screw 18 of the handwheel 16 and the pitch of the corresponding screw nut of the kinematic element 3 is chosen so as to allow a high rapidity of operation, guaranteeing furthermore conditions of non-return of the system.

This arrangement allows to easily and promptly vary the extension of the shaper, by simply turning the operating member 17 of the screw handwheel 16: this rotation in fact causes a more or less marked deformation of the configuration of the kinematic element 3 with respect to an ideal flat condition, said handwheel 16 and the thick end section 11 of said element 3 both sliding into the guides 20, and determining the consequent approach or spreading apart between the toe 1 and the heel 2 of the shaper.

FIG. 1 shows the condition of maximum approach—up to contact—between the toe 1 and the heel 2, while FIG. 2 illustrates a more extended condition of the shaper, both figures clearly evidencing how the single positions are obtained as a result of the different configuration taken up—thanks to the presence of the hinges 12, 13, 14 and 15—by the kinematic element 3 and, in particular, by the group of thick sections 10 of the strip 4 forming said element. FIG. 2 also shows, in dashed lines, how the heel 2 may simply rotate in respect of the remaining part of the shaper, thanks to the hinges obtained in the connection of the kinematic element 3 with said heel 2.

It is evident how the described shaper can be produced with a few pieces obtained by molding of plastic material and mounted with great rapidity and simplicity, without the use of special fixtures and without the possibility of mistakes, so as to be produced at low cost, while being at the same time exceptionally functional, of easy, convenient and rapid use, both for what concerns its introduction into the shoe, once adjusted—thanks to the simple oscillation of the heel 2 in respect of the remaining part of the device—and for what concerns its adjustment, which is carried out by quick and limited rotary movements imparted to the handwheel operating member. Furthermore the whole mechanism is contained in the lower part of the shaper, or is partially hidden in the toe neck part, whereby the shaper does not prevail to the eye, over the shoe for which it is meant, as was desirable. All this can be done without in the least sacrificing the handiness of the operating member which, as said, ensures great functionality in use.

On the other hand, the shaper according to the invention could be produced, as well as with low cost molded parts of plastic material, also by using traditional high-quality materials for the toe and heel, so that there are no limitations to the characteristics of quality of the article.

It is understood that the invention is not limited to the heretofore described and illustrated embodiment thereof, but that there may be other embodiments of the improved shaper falling within the scope of the invention itself.

We claim:

1. Extensible shoe shaper having a front toe part and a rear heel part, characterized in that, the connection between the front part and the rear part is obtained by means of a kinematic hinge element formed of a single strip of material of varying thickness, wherein the hinge function is performed by portions of reduced thickness of the strip of material, and the configuration of the hinge element can be varied by means of a screw handwheel which is slidably fixed along one of said parts and acting on said hinge element.

2. Extensible shoe shaper as in claim 1, wherein the kinematic hinge element is formed of a single strip of synthetic plastic material of varying thickness.

3. Extensible shoe shaper as in claim 1, wherein said kinematic element is fixed to the toe by pressure joints and connected to the heel by means of pressure hinges.

4. Extensible shoe shaper as in claim 3, wherein the toe comprises a pair of guides, into which are slidably housed a flange for connection of the screw handwheel and the portion of the material strip hinged to the heel.

* * * * *